United States Patent [19]

Blum

[11] Patent Number: 4,628,717

[45] Date of Patent: Dec. 16, 1986

[54] PROTECTIVE KEY HOLDER

[76] Inventor: Alvin S. Blum, 2350 Del Mar Pl., Fort Lauderdale, Fla. 33301

[21] Appl. No.: 783,675

[22] Filed: Oct. 3, 1985

[51] Int. Cl.[4] ..... A47G 29/10; B26B 3/00

[52] U.S. Cl. ..... 70/456 R; 30/162

[58] Field of Search ..... 70/456 R–459; 30/162, 335; 7/118, 170

[56] References Cited

U.S. PATENT DOCUMENTS

| | | | |
|---|---|---|---|
| 1,434,388 | 11/1922 | Hughes | 30/162 |
| 1,456,786 | 5/1923 | De Luca | 30/162 |
| 1,924,134 | 8/1933 | Segal | 70/456 R |
| 1,960,130 | 5/1934 | Truble | 30/162 |
| 1,974,547 | 9/1934 | Slade | 70/456 R |
| 2,129,915 | 9/1938 | DuPont | 70/456 R |
| 2,284,168 | 5/1942 | Richenbacher | 30/162 |
| 2,316,655 | 4/1943 | Voos | 70/456 R |
| 2,558,265 | 6/1951 | Mosch | 70/456 R |
| 2,569,080 | 9/1951 | Trimble | 30/162 |
| 2,608,890 | 9/1952 | Andrews | 30/162 |
| 2,699,192 | 1/1955 | Poutinen | 70/456 R |
| 2,870,537 | 1/1959 | Ortner | 30/162 |
| 2,948,961 | 8/1960 | Ortner | 30/162 |
| 3,296,429 | 1/1967 | Schwartz | 70/456 R |
| 4,298,999 | 11/1981 | Mackey | 7/170 |

FOREIGN PATENT DOCUMENTS

| | | | |
|---|---|---|---|
| 2424323 | 11/1975 | Fed. Rep. of Germany | 7/118 |
| 600486 | 12/1959 | Italy | 70/456 R |

*Primary Examiner*—Gary L. Smith
*Assistant Examiner*—Suzanne L. Dino
*Attorney, Agent, or Firm*—Alvin S. Blum

[57] ABSTRACT

A keycase enclosing a sliding blade knife. Blade exposed and sheathed with one hand by thumb action. Provides protection going to and from locked automobile and residence while holding preselected key. Spring loaded detent holds blade open or closed. Keycase serves as knife handle and sheath. Thin flat knife enclosure lies snugly against keycase wall occupying little space and not interfering with key holder function.

12 Claims, 7 Drawing Figures

PROTECTIVE KEY HOLDER

FIELD OF THE INVENTION

This invention relates to a holder for keys incorporating a sliding blade knife.

BACKGROUND OF THE INVENTION

We are forced to lock our vehicles, residences and places of business to deny access to criminals. When we approach these locks with key in hand, we, too, are vulnerable to personal attack by these criminals. Defensive experts advise us to ward off an attack by stabbing with whatever is at hand, even a key. This is not very effective. We can carry a weapon in the other hand, but this leaves no hand for packages, or door opening, and the user must find storage for the weapon when not in use.

SUMMARY OF THE INVENTION

It is an object of the present invention to provide a holder for holding keys that can also serve as a knife to protect the user from attack while approaching a door lock with key in hand. It is an object of the present invention to provide a knife with a blade that can be readily deployed or retracted by thumb or finger of the same hand holding a key ready for unlocking a door. It is an object of the present invention to provide a key holder with a retractable knife blade whose protective knife function will not interfere with the normal key holding function. It is an object of the present invention to provide a retractable blade knife and keyholder whose key holding function will not interfere with normal knife function. It is an object of the present invention to provide a key holder with retractable blade knife having a thin, flat knife structure incorporated into the keyholder structure so as to occupy little more space than an ordinary keyholder. It is an object of the present invention to provide a keycase with sliding blade knife wherein the keycase serves as a handle for the knife when blade is exposed and a sheath for the blade when it is retracted. These and other objects and advantages of the invention will become evident from the detailed description of preferred embodiments of the invention which follow.

BRIEF DESCRIPTION OF THE ILLUSTRATIONS

DETAILED DESCRIPTION OF THE PREFERRED EMBODIMENTS

Figure 2:
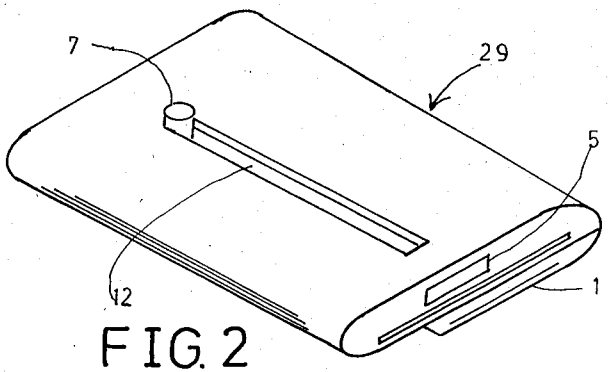
FIG. 2 is a perspective view of the keycase with blade retracted and keys closed as it would be stored in pocket or purse.
Figure 1:
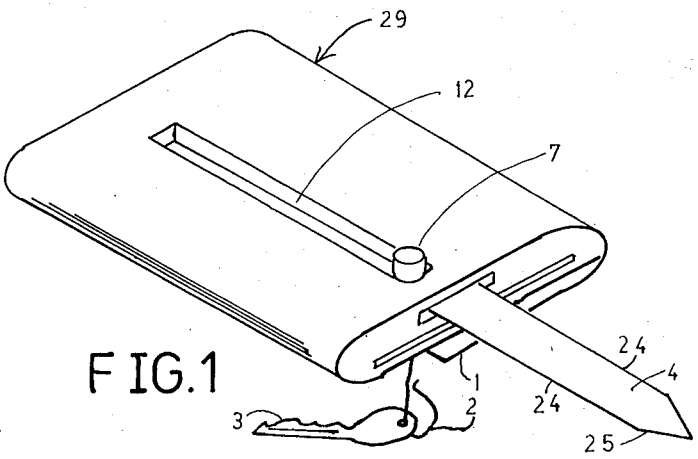
FIG. 1 shows, in perspective, the keycase closed, with key selected and blade exposed, ready to use for protection.
Figure 3:
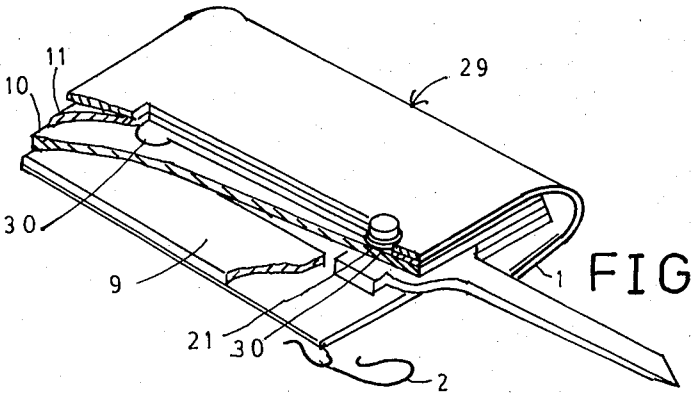
FIG. 3 shows a perspective of the keycase with a portion broken away.

Referring now to FIGS. 1, 2 and 3, which illustrate a keycase of the invention, FIG. 1 shows the keycase in the condition it would be in for travel to a locked door, such as a vehicle in a parking lot while carrying a package in one hand. Before leaving the safety of the building, the vehicle key 3 is removed from the case 29, the flexible outer covering 1 is closed and snapped shut over the remaining keys. The key 3, still attached to the keycase by key clip 2, is held flat against the outside of the case as the case is grasped tightly in the hand. The second hand is now free to carry the package, open doors, and the like. As one leaves the safety of the building, the thumb of the hand grasping the keycase depresses pushbutton 7 and slides it along cover slot 12 from the rearmost position of FIG. 2 to its forward position of FIGS. 1 and 3, thereby extending knife blade 4 to its outermost position, ready for use. Pushbutton 7 is a spring loaded detent holding the blade fully sheathed as in FIG. 2 in a first locked position and fully extended as in FIGS. 1 and 3 in a second locked position. Pressing the pushbutton 7 forces the enlarged portion 21 of the detent pushbutton below the detent holding plate 10, unlocking the blade 4 so that it is free to slide to and fro in the blade channel plate 9. With the thumb released from the pushbutton and the keycase and key gripped firmly in the hand, the keycase serves as a firm handle for the knife blade 4, whose sharpened edges 24 and point 25 can be used as an effective defensive weapon and to relieve anxiety. When the user reaches the locked door, the thumb depresses the pushbutton and slides it back to retract the blade into the blade opening 5. This sheaths the blade safely within the keycase. The fingers now release the key and insert it into the lock. After use the key is returned to the case, the cover 1 snapped shut, and the keycase, as shown in FIG. 2, is ready for safe storage in pocket or purse. The keycase incorporating the knife will occupy little more space than a conventional keycase and will be just as easy to use.

Figure 4:
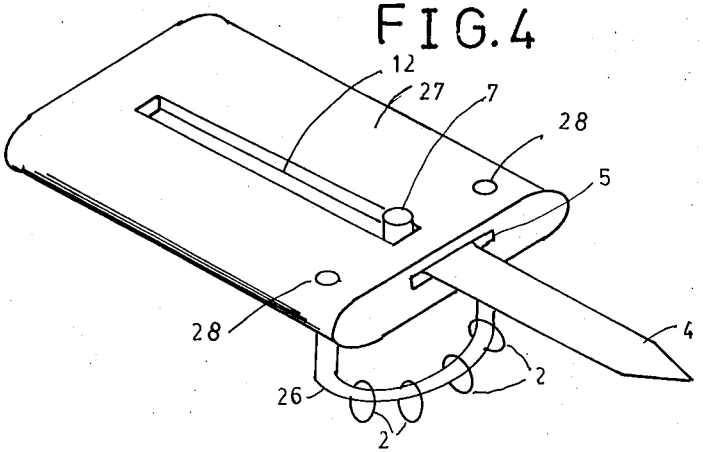
FIG. 4 shows a perspective of a keyring embodiment of the invention.

FIG. 4 shows a keyring embodiment of the invention. A ring 26 holds many key clips 2, and a rigid, flat sheath assembly 27 is fastened to the ring 26 by fasteners 28.

Figure 5:
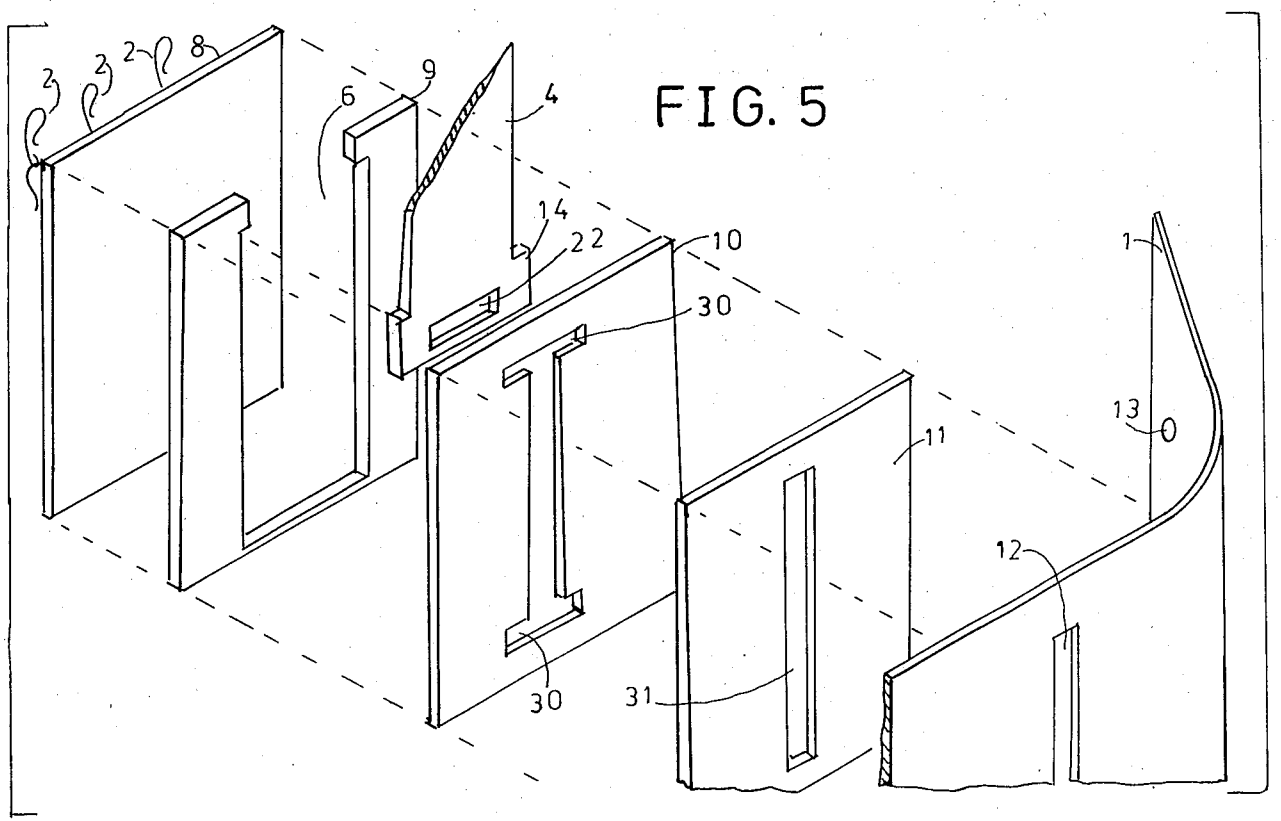
FIG. 5 is an exploded view of the keycase.

FIG. 5 shows an exploded view of the keycase to more clearly depict its structure. It is constructed of a series of layers which may be tightly joined together by welding, adhesives, rivets and the like. Base plate 8 holds key clips 2 as is well known in the prior art. Blade channel plate 9 has a blade channel 6 in which blade 4, shown partially broken away, slides between exposed and sheathed positions. Slot 22 in blade base 14 holds a spring-loaded pushbutton detent 17, not shown in FIG. 5, but shown in detail in FIG. 6. Detent holding plate 10 has expanded openings 30 into which detent locks under spring force at either end of its travel. Slot plate 11 provides pushbutton slot 31 to guide the travel of the pushbutton. Flexible outer covering 1, generally of leather, provides cover slot 12 for the pushbutton. Snap closure 13 in cover 1 secures the leather case as is well known in the art. In an alternative embodiment, plates 9,10 and 11 may be molded of one piece.

Figure 7:
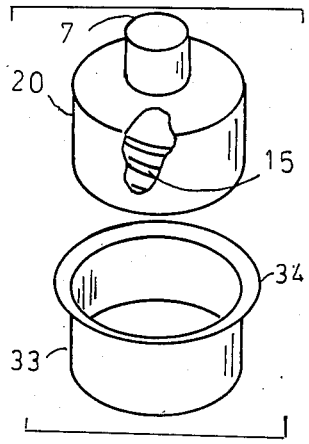
FIG. 7 is a perspective view of a cylindrical pushbutton detent.
Figure 6:
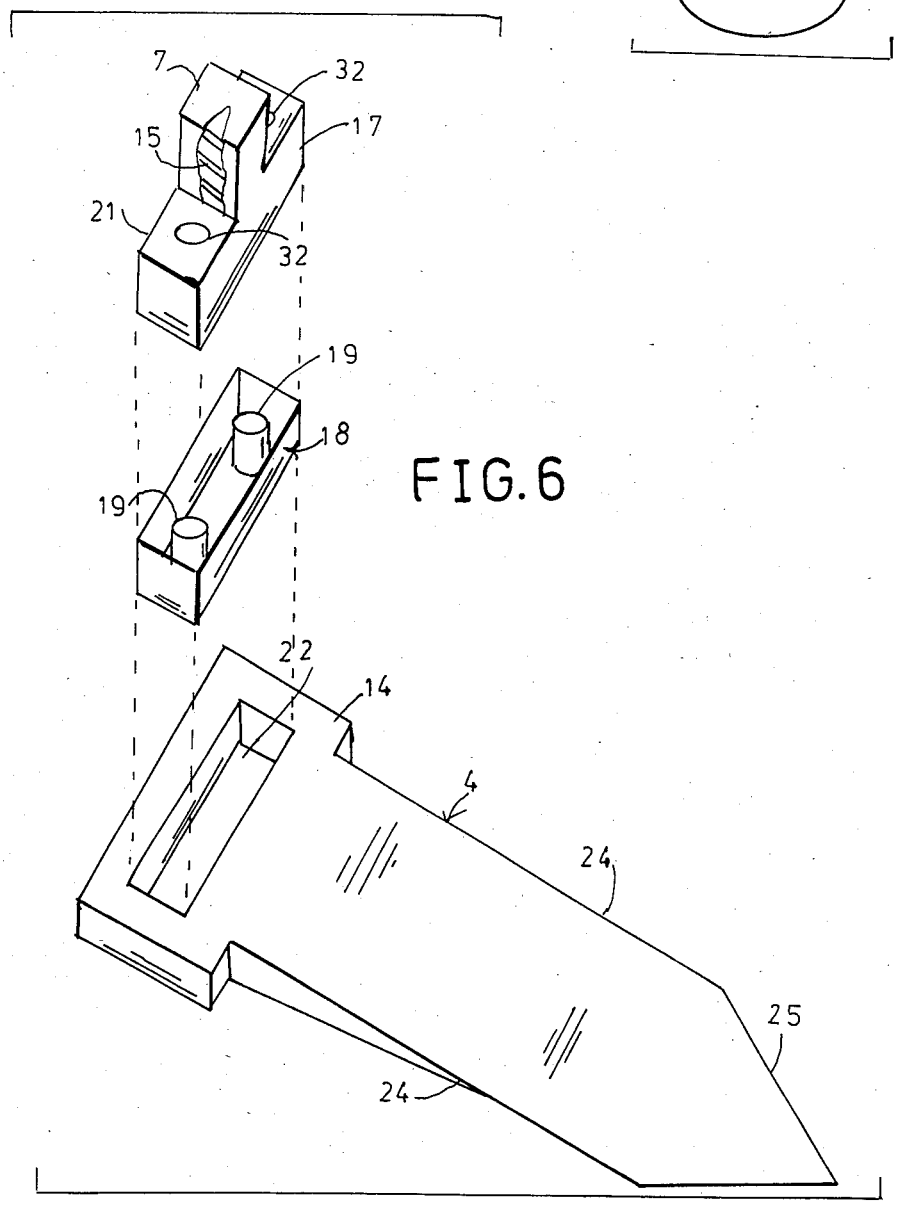
FIG. 6 is a perspective view of the blade and a transverse pushbutton detent.

FIG. 6 details the transverse detent structure such as is used in FIG. 5. In the base 14 of blade 4 is a transverse slot 22. A thin walled detent receiver 18, having cylindrical guide pins 19, is press fitted into the slot 22. Detent 17 fits into receiver 18, with guide pins 19 fitting into guide holes 32. A compression coil spring 15 showing through the broken away portion of hollow pushbutton 7 presses against the bottom of detent receiver 18, biasing the detent up out of slot 22, holding the blade locked at either end of travel when enlarged portion 21 fits into expanded openings 30 in detent holding plate 10 (FIG. 5). When the thumb depresses the pushbutton 7, spring 15 is compressed and the enlarged portion 21 of detent 17 is forced into receiver 18 so that it is flush with the blade and the blade is free to slide (unlocked). FIG. 7 shows a cylindrical form of detent 20. The detent receiver 33 has a lip 34. This is the type detent shown in FIG. 3.

The above disclosed invention has a number of particular features which should preferably be employed in combination although each is useful separately without departure from the scope of the invention. Inasmuch as the invention is subject to many variations, modifications, and changes in detail, it is intended that all matter described above be interpreted as illustrative and not in a limiting sense.

What is claimed is:

1. A protective keyholder, operable with one hand, for holding a plurality of keys in combination with a sliding blade knife that can be exposed for defensive use and sheathed for safety while a selected key is exposed ready for use in unlocking a lock, comprising:

a. a plurality of key clip means for holding individual keys;

b. a key clip means support means having a broad dimension across which said key clip means are linearly supported to facilitate selection of a particular key for exposed use;

c. a sliding knife blade having two opposed, substantially flat sides, two narrow edges, at least one of which is sharp, a pointed end and a base end, said base end including pushbutton engaging means;

d. pushbutton means engaging said base end of said blade for reversably sliding said blade between a first, sheathed position, and a second, exposed position, said pushbutton means including locking means for locking said blade in said first and second position, and said pushbutton means preventing said blade from detaching from said keyholder;

e. sheathing means enclosing said blade on said flat sides, said edges and said base when in sheathed position, said sheathing means providing two slot-shaped apertures, a first aperture through which said pointed end slidably passes to expose said blade in said exposed position and a second aperture through which said pushbutton means passes and along which it slides when exposing or sheathing said blade;

f. flexible cover means for reversibly enclosing said keys in a first, closed position and for providing access to said keys in a second, open position, said key clip support means disposed relative to said cover means to enable a selected key to be exposed while other keys are enclosed in said closed position; said sheathing means connected to said key clip support means with said broad dimension of said support means parallel to said flat sides of said knife blade, with said key clips on a first face of said support means and said sheathing means on an opposite second face of said support means to provide a combination whose dimensions exceed those of a keyholder without a knife by a minimal amount to provide a convenient and easily grasped unit and to dispose said blade and its pushbutton control so that they are operable by the same hand holding said exposed key for use in unlocking a lock; said sheathing means, said cover means, said enclosed keys and said support means in combination providing a grasping handle for defensive use of said blade when in exposed position.

2. In the invention of claim 1, said blade so disposed that it extends from the same end of said support means that said key extends from when both are extended for use to enable quick selection of either for use in an emergency.

3. The invention of claim 1 further comprising spring-loaded detent means connected to said pushbutton means, said detent means locking said knife blade in sheathed and unsheathed positions by spring action and unlocking said knife blade when pushbutton is depressed to free said blade for sliding.

4. In the invention of claim 1, said sheath means comprised of a series of laminated metal plates forming the sheath and handle for said knife blade.

5. The invention of claim 1, said sheathing means including a plate means, said plate means forming one wall of said sheathing means parallel to said flat sides of said blade, said plate means also serving as said key clip support means.

6. The invention of claim 5, said sheathing means comprising said plate means connected to a single molded element.

7. In the invention of claim 1, said pushbutton means projecting from said base of said blade, through said second aperture in said sheathing means to an exposed position opposite the opening provided in said cover means when said cover means is in said open position.

8. A protective keyholder for holding a plurality of keys in combination with a knife, the combination operable with one hand, comprising:

key holding means for holding a plurality of keys disposed along a linear dimension to facilitate selection of a particular key for use;

key holding support means connected to said key holding means; sliding blade knife means attached to said support means, said sliding blade knife means including;

(a.) a sliding knife blade with narrow edges, substantially flat sides, a sharp point and a base;

(b.) a pushbutton sliding means engaging said blade at said base to prevent removal of said blade and for sliding said blade between two lockable positions, a first, sheathed position for safe blade storage and a second, unsheathed position for use as a defensive weapon; and (c.) a sheath means enclosing said blade in said sheathed position and providing a sliding channel for sliding said blade to said unsheathed position wherein said base of said blade is held securely in locked position by said channel and said point and edges of said blade are exposed for defensive use; said sheath means is connected to said support means to dispose said flat sides of said blade parallel to said linear dimension to provide a combination whose dimensions exceed those of a keyholder without a knife by a minimal amount and to provide a combination support means and sheath means that can serve as a convenient grasping handle for said knife blade when said blade is in exposed position.

9. The invention of claim 8, further comprising spring-loaded detent means connected to said pushbutton sliding means, said detent means locking said knife blade in sheathed and unsheathed positions by spring action and unlocking said knife blade when pushbutton is depressed to free said blade for sliding.

10. The invention of claim 8, wherein said sliding blade knife means is comprised of a series of laminated metal plates forming the sheath and handle for said knife blade.

11. The invention of claim 8, wherein the sliding blade knife means includes a plate forming one wall of said sheath means, said plate also comprising said key holding support means.

12. The invention of claim 11, wherein said sheath means comprises said plate connected to a single molded element.

* * * * *